US010835833B2

(12) United States Patent
Grogan et al.

(10) Patent No.: US 10,835,833 B2
(45) Date of Patent: Nov. 17, 2020

(54) SYSTEM AND METHOD FOR TRACK RIDE VEHICLE ORIENTATION

(71) Applicant: Universal City Studios LLC, Universal City, CA (US)

(72) Inventors: Barry Grogan, Orlando, FL (US); Brandon Mallory Bauman, Orlando, FL (US); Ted W. Van Winkle, Celebration, FL (US)

(73) Assignee: Universal City Studios LLC, Universal City, CA (US)

( * ) Notice: Subject to any disclaimer, the term of this patent is extended or adjusted under 35 U.S.C. 154(b) by 497 days.

(21) Appl. No.: 15/697,159

(22) Filed: Sep. 6, 2017

(65) Prior Publication Data

US 2019/0070515 A1 Mar. 7, 2019

(51) Int. Cl.

| | |
|---|---|
| ***A63G 7/00*** | (2006.01) |
| ***E01B 25/04*** | (2006.01) |
| ***A63G 21/04*** | (2006.01) |
| ***A63G 21/14*** | (2006.01) |

(52) U.S. Cl.

CPC ..... *A63G 7/00* (2013.01); *A63G 21/04* (2013.01); *A63G 21/14* (2013.01); *E01B 25/04* (2013.01)

(58) Field of Classification Search

CPC ..... A63G 7/00; A63G 21/04; A63G 21/14; E01B 23/06; E01B 25/04

See application file for complete search history.

(56) References Cited

U.S. PATENT DOCUMENTS

| | | | |
|---|---|---|---|
| 4,037,738 | A | 7/1977 | Johnson |
| 4,207,821 | A | 6/1980 | Beckert |
| 6,006,672 | A | 12/1999 | Newfarmer et al. |
| 6,502,688 | B1 | 1/2003 | Krooss et al. |
| 7,093,705 | B2 * | 8/2006 | Ohiro ..... A61F 13/15764 198/374 |
| 8,038,541 | B1 | 10/2011 | Solomon |
| 8,578,857 | B2 | 11/2013 | Crawford et al. |

(Continued)

FOREIGN PATENT DOCUMENTS

| | | |
|---|---|---|
| DE | 20316695 U1 | 3/2005 |
| EP | 0168341 | 1/1986 |

(Continued)

OTHER PUBLICATIONS

PCT/US2018/046091 International Search Report and Written Opinion dated Oct. 16, 2018.

*Primary Examiner* — Jason C Smith

(74) *Attorney, Agent, or Firm* — Fletcher Yoder P.C.

(57) ABSTRACT

In accordance with one embodiment, a system includes a dual-track loop including a first track loop and a second track loop, a single-track loop spaced apart from the dual-track loop, and a cross-track extending between the dual-track loop and the single-track loop. The system also includes a platform disposed on the cross-track. The platform is configured to translate between a position aligned with the first track loop and the second track loop of the dual-track loop and a position aligned with a first portion and a second portion of the single-track loop. The system further includes a turntable coupled to the platform and configured to rotate a ride vehicle positioned on the turntable and to change an orientation of the ride vehicle relative to a fixed portion of the platform.

19 Claims, 4 Drawing Sheets

(56) References Cited

U.S. PATENT DOCUMENTS

| | | | | |
|---|---|---|---|---|
| 9,084,941 | B1 | 7/2015 | Fram | |
| 9,957,119 | B2 | 5/2018 | Wernersbach et al. | |
| 2005/0092580 | A1* | 5/2005 | Clemens | B65G 47/22 198/416 |
| 2019/0070515 | A1* | 3/2019 | Grogan | A63G 7/00 |

FOREIGN PATENT DOCUMENTS

| | | | | |
|---|---|---|---|---|
| EP | 3031756 | A1 * | 6/2016 | B65G 47/642 |
| JP | 3073297 | B2 | 8/2000 | |
| WO | 0034100 | | 6/2000 | |

* cited by examiner

FIG. 1
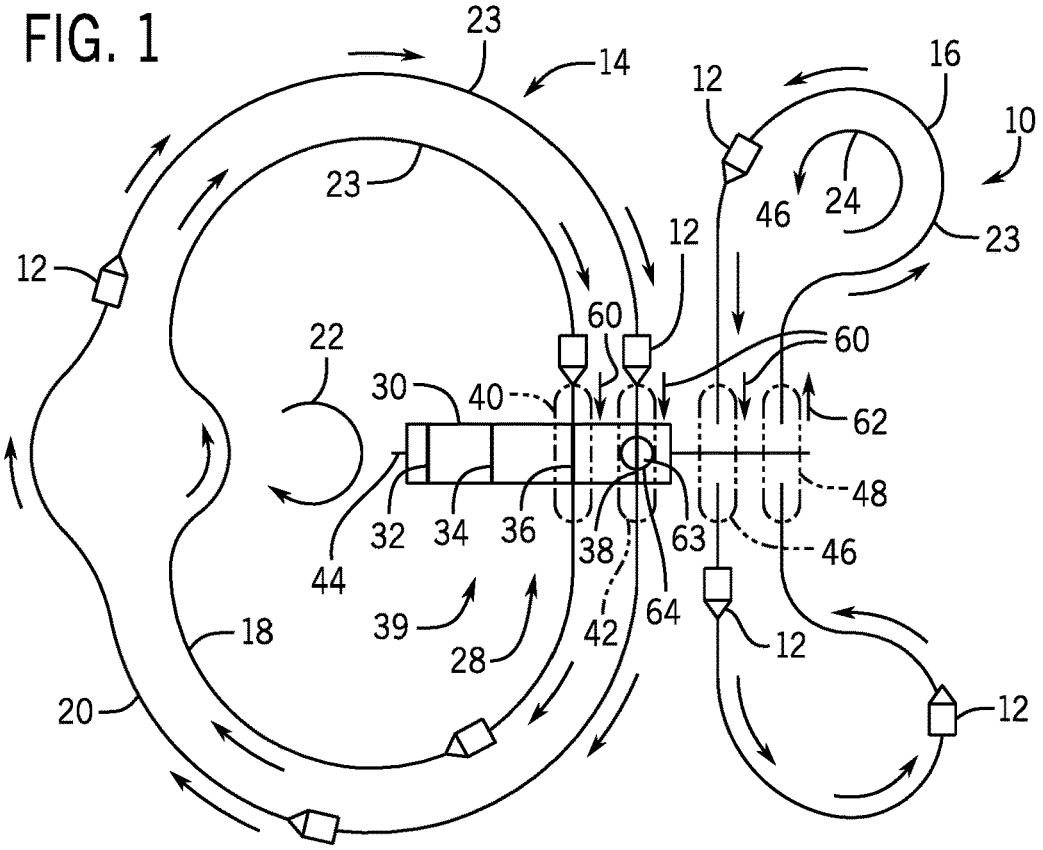
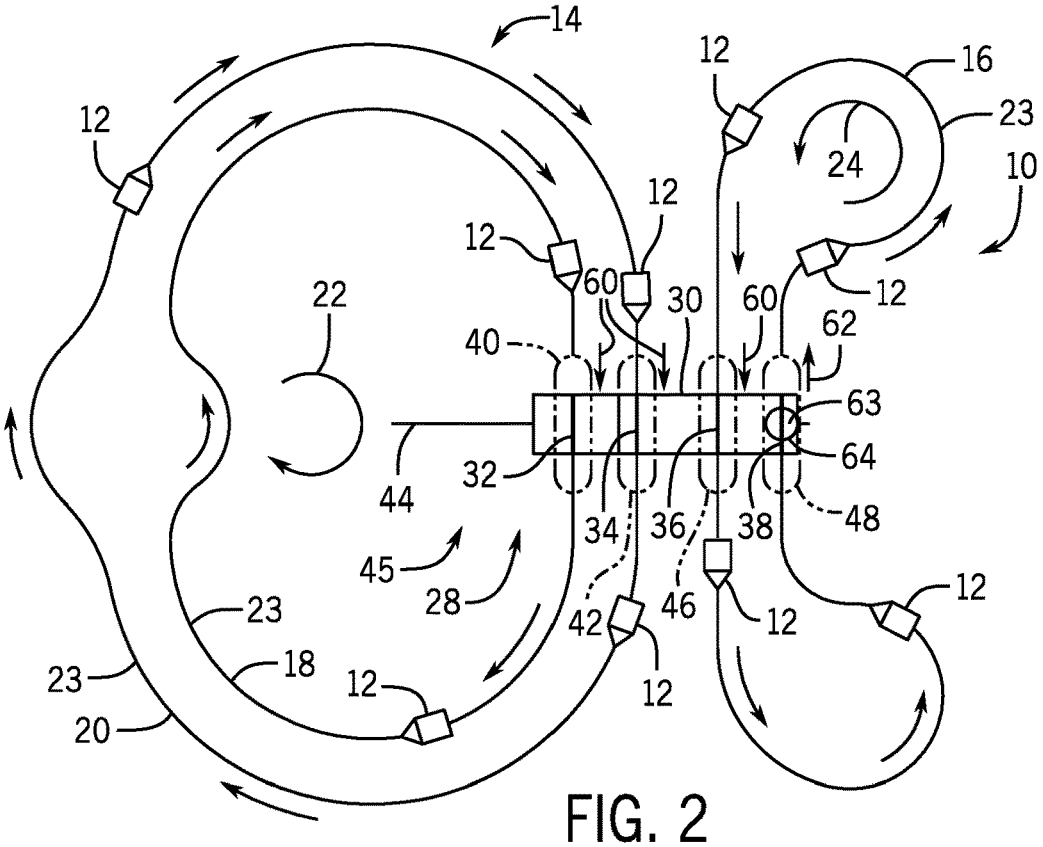
FIG. 2

SYSTEM AND METHOD FOR TRACK RIDE VEHICLE ORIENTATION

FIELD OF DISCLOSURE

The present disclosure relates generally to the field of amusement parks. More specifically, embodiments of the present disclosure relate to methods and equipment used in conjunction with amusement park games or rides.

BACKGROUND

Various forms of amusement rides have been used for many years in amusement or theme parks. These include traditional rides such as roller coaster and/or track rides. Many rides may include one or more track loops that ride vehicles may move along. Particularly, an amusement ride may include adjacent or side-by-side track loops (e.g., an attraction loop and an auxiliary or maintenance loop) in which it may be desirable to transfer ride vehicles between tracks of the adjacent loops. It is now recognized that traditional systems and methods for transferring ride vehicles between adjacent tracks may orient the vehicles incorrectly and/or may utilize inefficient labor intensive methods.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, a system includes a dual-track loop including a first track loop and a second track loop, a single-track loop spaced apart from the dual-track loop, and a cross-track extending between the dual-track loop and the single-track loop. The system also includes a platform disposed on the cross-track. The platform is configured to translate between a position aligned with the first track loop and the second track loop of the dual-track loop and a position aligned with a first portion and a second portion of the single-track loop. The system further includes a turntable coupled to the platform and configured to rotate a ride vehicle positioned on the turntable and to change an orientation of the ride vehicle relative to a fixed portion of the platform.

In another embodiment, a system includes a platform. The platform includes a stationary portion and a rotational portion. The system also includes a track segment coupled to the rotational portion, which is configured to rotate relative to the stationary portion to cause the track segment to rotate. The system further includes a motor coupled to the rotational portion and configured to rotate the rotational portion, and a rail coupled to the platform such that the stationary portion and the rotational portion of the platform are configured to translate along the rail.

In another embodiment, a method includes receiving on a first track segment of a platform a first ride vehicle from a first track, receiving on a second track segment of the platform a second ride vehicle from a second track, and translating the platform to move the first ride vehicle away from the first track to align the first track segment with a first portion of a third track loop and to move the second ride vehicle away from the second track to align the second track segment with a second portion of the third track loop. The method also includes rotating, via a turntable, the second ride vehicle, dispatching the first ride vehicle from the platform to the third track loop, and dispatching the second ride vehicle from the platform to the third track loop.

DRAWINGS

These and other features, aspects, and advantages of the present disclosure will become better understood when the following detailed description is read with reference to the accompanying drawings in which like characters represent like parts throughout the drawings, wherein:

FIG. 1 is a schematic view of an embodiment of a ride system that may utilize a platform to transfer ride vehicles, in accordance with the present techniques;

FIG. 2 is a schematic view of an embodiment of the ride system of FIG. 1 that may utilize the platform to transfer ride vehicles, in accordance with the present techniques;

DETAILED DESCRIPTION

Figure 3:
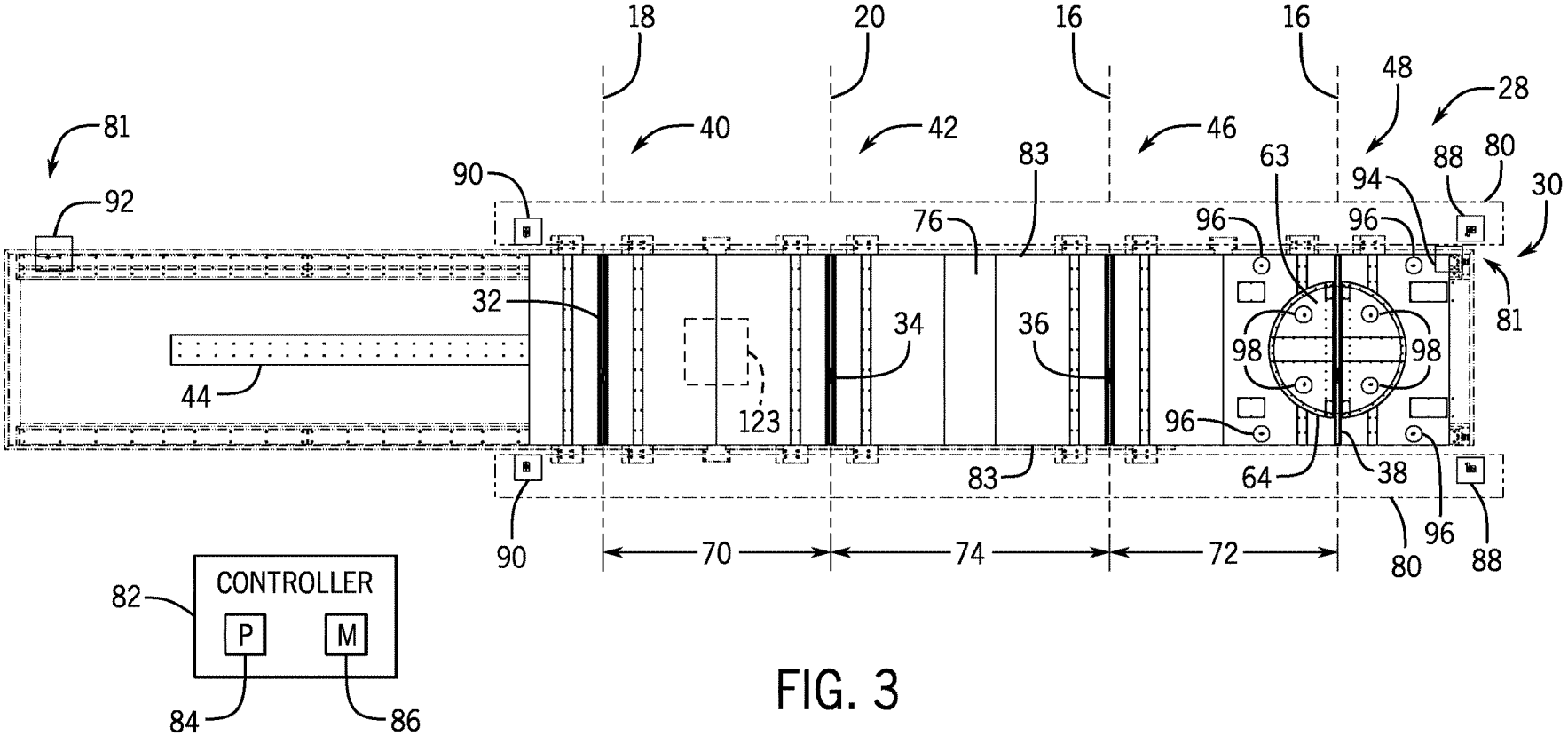
FIG. 3 is an overhead view of an embodiment of the platform of FIG. 1, in accordance with the present techniques.

The present disclosure provides a system and method to transfer one or more ride vehicles between adjacent tracks (e.g., track loops). For example, in certain types of amusement rides, during operation of the ride, passengers may travel along one or more attraction track loops in a ride vehicle. The attraction track loops may be arranged as substantially concentric and, in certain embodiments may include an arrangement with at least a portion of the attraction track loops being parallel. In some embodiments, it may be desirable to transfer the vehicles to an adjacent (e.g., a nearby or spaced apart by a distance) auxiliary loop for various reasons such as maintenance, amusement ride reconfigurations, etc. However, transferring the ride vehicles between the attraction track loops and the auxiliary loop may be challenging. Particularly, a simple translation of a ride vehicle between the tracks may not orient the ride vehicle correctly.

Accordingly, provided herein is a track switch assembly that may be used in conjunction with the disclosed system and method and that facilitates vehicle translation and reorientation between adjacent track loops, e.g., between an attraction track loop and a maintenance track loop. In certain embodiments, the track switch assembly permits vehicles from different loops of a multi-loop attraction to be simultaneously moved onto a single maintenance loop such that they are both oriented the same direction (e.g., both clockwise or both counterclockwise). In contrast to techniques in which a translation onto a maintenance loop to circumferentially opposed points on the loop would yield two vehicles that where oriented in opposing directions, the track switch assembly permits rotation of at least one of the vehicles to achieve the correct or desired orientation of both vehicles. In addition, in certain embodiments, the track switch assembly also includes one or more additional track segments that close the attraction loop or loops to permit subsequent vehicles to move along the attraction loop. In this manner, moving vehicles onto an adjacent auxiliary loop provides minimal disruption to the attraction. While the present discussion focuses on track loops, present embodiments may include tracks without loops as well.

In one implementation, a ride attraction may include two substantially concentric attraction track loops (e.g., an internal attraction loop and an external attraction loop) and a single auxiliary loop with at least a portion of the auxiliary loop disposed adjacent to portions of the external attraction loop. The two attraction loops may flow clockwise and the auxiliary loop may flow counter-clockwise. In this manner, the portions of the two attraction loops that are disposed adjacent to the auxiliary loop may flow in the same linear direction as a first portion of the auxiliary track to which the two attraction loops are adjacently disposed. Further, it should be noted that the auxiliary loop may be configured such that a second portion of the auxiliary loop (the second portion being disposed on a substantially opposite side of the auxiliary track relative to the first portion of the auxiliary track) is disposed adjacent the first portion of the auxiliary track on a side of the first portion of the auxiliary loop that is opposite of the two attraction loops. Indeed, considering the counter-clockwise flow of the auxiliary loop, the second portion of the auxiliary loop may flow in a direction opposite of the portions of the two attraction loops and first portion of the auxiliary loop. An embodiment of such a configuration is illustrated in FIG. 1.

Therefore, given the different directions of flow, particularly with the portions of the attraction loop and the first portion of the auxiliary loop flowing in a first direction and the second portion of the auxiliary loop flowing in a second (opposite) direction, it may be difficult to transfer two vehicles between the attraction loops and the auxiliary loop. Indeed, ride vehicles may be oriented in the first direction on the attraction loops and cannot simply be translated to the adjacent first and second portions of the auxiliary loop in a single translation or switch operation. For example, a ride vehicle which is being transferred from the external attraction loop may also require a rotation to the correct orientation when transferred to the second portion of the auxiliary loop. Present embodiments utilize efficient techniques to rotate the ride vehicle to a suitable orientation.

In certain embodiments, amusement rides are provided that include a translational platform with a rotational portion that may transfer one or more ride vehicles between adjacent track loops. The translational platform may move along a transfer track that is disposed perpendicular to the track loops between which the one or more vehicles are transferred. The translational platform may utilize one or more motors and detection systems to efficiently transfer the ride vehicles and rotate one of the ride vehicles as necessary in order to transfer and orient the ride vehicles on the adjacent track.

With the foregoing in mind, FIG. 1 illustrates a perspective view of a ride system 10 that may transfer and orient ride vehicles 12 between tracks as disclosed herein. The ride system 10 may include one or more attraction loops 14 (e.g., a dual-track loop) and an auxiliary loop 16 (e.g., a single-track loop). Particularly, in the current embodiment, the attraction loops 14 include an internal loop 18 and an external loop 20 with ride vehicles 12 moving in the clockwise direction 22 along one or more tracks 23. Further, the auxiliary loop 16 may be a single loop with ride vehicles 12 moving along the track 23 in the counter-clockwise direction 24. To this end, a track switch assembly 28 may transfer the ride vehicles 12 between the attraction loops 14 and the auxiliary loop 16.

The track switch assembly 28 includes a platform 30 that may be a substantially rigid or resilient object with one or more segments of track 23 disposed thereon. Particularly, the platform 30 may include a first track segment 32, a second track segment 34, a third track segment 36, and a fourth track segment 38. However, it should be understood that the track switch assembly 28 and the platform 30 may be implemented with more or fewer track segments, depending on the arrangement and number of loops. Further, each of the track segments 32, 34, 36, and 38 may represent rail pairs, monorails, or other track types.

In operation, the platform 30 may move or translate between portions of the attraction loops 14 and the auxiliary loop 16. For example, as depicted in FIG. 1, the platform 30 is located in a primary position 39 such that the third track segment 36 is located at or aligned with a first portion 40 of the track 23 of the internal loop 18 and the fourth track segment 38 is located at or aligned with a second portion 42 of the track 23 of the external loop 20. However, as depicted in FIG. 2, the platform 30 may move along a platform track 44 (e.g., cross-track, rail) or conveyer of the track switch assembly 28 to a secondary position 45 to cause all of the track segments 32, 34, 36, 38 of the platform to be translated along to the platform track 44. As a result, in the secondary position 45, the first track segment 32 is located at the first portion 40 of the internal loop 18 and the second track segment 34 is located at the second portion 42 of the external loop. While the depicted embodiment shows the secondary position 45 as aligning the platform 30 of the track switch assembly 28 such that all of the track segments 32, 34, 36, 38 are aligned with corresponding tracks 23 of the attraction loops 14 and the auxiliary loop 16, it should be understood that the platform 30 may also assume one or more intermediate positions between the primary position 39 and the secondary position 45. The intermediate positions of the platform 30 may be characterized by at least one track segment 32, 34, 36, 38 being aligned with the track 23 of the attraction loops 14 or the auxiliary loop 16.

In some embodiments, the platform track 44 may include two or more separate tracks along which the platform 30 may move. Moreover, while the platform 30 is in the secondary position 45, the third track segment 36 may be located in a third portion 46 of the auxiliary loop 16 and the fourth track segment 38 may be located in a fourth portion 48 of the auxiliary loop 16. Therefore, the distance between the first and second portions 40, 42 may be substantially the same as the distance between the third and fourth portions 46, 48. Similarly, the distance between the first and second track segments 32, 34 of the platform 30 may be substantially the same as the distance between the third and fourth track segments 36, 38. Additionally, the second and third portions 42, 46 may be likewise spaced to facilitate intermediate alignments.

Particularly, the loops 14, 16 and the track segments 32, 34, 36, 38 may be spaced and positioned as described above to further enable the transfer of ride vehicles 12 between the attraction loops 14 and the auxiliary loop 16. For example, the ride vehicles 12 may move along attraction loops 14 and stop within the first and second portions 40, 42 of the attraction loops 14 such that the ride vehicles 12 are disposed on the third and fourth track segments 36, 38 while the platform 30 is in the primary position 39. The platform may then shift (e.g., translate) to the secondary position 45 such that the third and fourth track segments 36, 38 are disposed along, aligned, or collinear with, the third and fourth portions 46, 48 of the auxiliary loop 16, respectively. Further, while in the secondary position 45, the first and second track segments 32, 34 of the platform 30 may be disposed along, aligned, or collinear with, the first and second portions 40, 42 of the attraction loops 14 such that gaps do not prevent the ride vehicles 12 from continuing to move along the internal and external loops 18, 20. Further, while in the secondary position 45, the third and fourth track segments 36, 38 may be disposed along the third and fourth portions 46, 48 of the auxiliary loop 16, respectively. Once the platform 30 is in the secondary position 45, the ride vehicles 12 that moved onto the platform 30 from the attraction loops 14 while the platform 30 was in the primary position 39 may move onto the auxiliary loop 16.

However, as mentioned above, due to the flow of the ride vehicles 12 on the attraction and auxiliary loops 14, 16, the ride vehicles 12 on the first portion 40, the second portion 42, and the third portion 46 may move in a first direction 60 while ride vehicles 12 on the fourth portion 48 move in a second direction 62. Therefore, the fourth track segment 38 of the platform 30 may be coupled to and/or disposed on a top surface 63 of a turntable 64 (e.g., rotational plate, circular plate, rotational portion, etc.) which may rotate, thereby rotating the fourth track segment 38, and by extension, also rotating the ride vehicle 12 disposed on the fourth track segment 38. As a result, any ride vehicle 12 positioned on the track segment 38 may be rotated such that the ride vehicle 12 is facing the correct direction (e.g., the first direction 60 for the second portion 42 of the external loop 20 and the second direction 62 for the fourth portion 48 of the auxiliary loop 16). Accordingly, the platform 30 may include one or more fixed track segments (e.g., track segments 32, 34, and 36) that are fixed in position relative to the platform but that translate together with the platform 30. The platform may also include one or more rotating track segments (e.g., track segment 38) that rotate with respect to the platform 30 as well as with respect to any fixed track segments and that also translate together with the platform 30. The rotation and translation may occur sequentially or simultaneously.

For example, the platform 30, and more specifically, the fourth track segment 38, may receive one of the ride vehicles 12 while disposed at the second portion 42 of the external loop 20 (e.g., while the platform 30 is in the primary position 39) and may then transfer the ride vehicle 12 to the fourth portion 48 of the auxiliary loop 16 in the secondary position 45. However, before the ride vehicle 12 moves off of the fourth track segment 38 and onto the auxiliary loop 16, the turntable 64 may rotate the ride vehicle 12 such that the ride vehicle 12 is facing the second direction 62 and is aligned with the track 23 of the auxiliary loop 16 in the fourth portion 48. The degree of rotation may be defined by the position of the receiving track 23 and the desired orientation of the ride vehicle 12. Rotation of the track segment 38 may cause a rotation from a generally parallel position with respect to the fixed track segments (e.g., track segments 32, 34, and 36) and the rotation may terminate at the desired alignment and orientation, which may also be parallel but 180 degrees rotated with respect to the fixed track segments.

Further, it should be noted that in some embodiments, the ride vehicles 12 may flow in the counter-clockwise direction 24 on the attraction loops 14 and in the clockwise direction 22 on the auxiliary loop 16. Additionally, in some embodiments, the ride vehicles 12 may flow in the clockwise direction 22 on both the attraction loops 14 and the auxiliary loop 16 or in the counter-clockwise direction 24 on both the attraction loops 14 and the auxiliary loop 16. Regardless, the track switch assembly 28 may transfer ride vehicles 12 between the attraction loops 14 and the auxiliary loop 16. For example, in some embodiments, in replace of or in addition to the turntable 64 rotating the fourth track segment 38, a second turntable may be coupled to and rotate the third track segment 36. Particularly, rotation of the third track segment 36 via the second turntable may be similar to rotation of the fourth track segment 38 via the turntable 64 as described herein. Indeed, rotation of the third track segment 36 and/or the fourth track segment 38 may be based at least in part on a direction of travel of the ride vehicle 12 on the auxiliary loop 16 relative to a direction of travel of the ride vehicle 12 on the attraction loops 14.

In some embodiments, the turntable 64 may rotate 180 degrees, or more or less than 180 degrees depending on the orientation of the external loop 20 and the auxiliary loop 16 at the second and fourth portions 42, 48, respectively. For example, the track 23 at the second portion 42 of the external loop 20 may be disposed at one angle and the track 23 at the fourth portion 48 of the auxiliary loop 16 may be disposed at a different angle. Accordingly, in such embodiments, the second portion 42 and the fourth portion 48 may not be parallel and the turntable 64 may rotate more or less than 180 degrees in order to transfer the ride vehicle 12 between the second portion 42 and the fourth portion 48. Regardless of the amount of rotation required by the turntable 64, the rotation of the ride vehicle 12 and/or the turntable 64 may occur while the platform 30 is in the primary position 39, while transitioning from the primary position 39 to the secondary position 45, while in the secondary position 45, or any combination thereof.

FIG. 3 is an overhead view of the platform 30 disposed on the platform track 44 within the ride system 10. As discussed above, the platform 30 may include the first, second, third, and fourth track segments 32, 34, 36, 38. The fourth track segment 38 may be disposed on the turntable 64, which is configured to rotate, thereby rotating the fourth track segment 38. A first distance 70 between the first track segment 32 and the second track segment 34 may be substantially equal to a second distance 72 between the third track segment 36 and the fourth track segment 38. However, the first and second distances 70, 72 may be less than a third distance 74 between the second track segment 34 and the third track segment 36. The difference between the first and second distances 70, 72 as compared to the third distance 74 may be attributed to an enlarged distance between the attraction loops 14 and the auxiliary loop 16. For example, in some embodiments, the enlarged distance between the loops 14, 16 may exist to accommodate a divider (e.g., wall, boundary, etc.) between the attraction loops 14 and the auxiliary loop 16 such that users of the ride system 10 may not have a visual perspective of the auxiliary loop 16 while moving in a ride vehicle 12 along a majority of either of the attraction loops 14. Accordingly, in some embodiments, the platform 30 may include a spacer 76 linking the first and second track segments 32, 34 to the third and fourth track segments 36, 38.

Although the platform 30 is depicted with a single turntable 64, it should be understood that additional turntables 64 may be present on the platform 30 to facilitate rotation of one or more additional track segments. Further, in embodiments with additional turntables 64, it should be understood that each may be independently controlled.

The ride system 10 may also include two or more vehicle detection systems 80 and two or more platform detection systems 81 coupled to the platform 30. The detection systems 80, 81 may communicate directly with a controller 82. The controller 82 may be any device employing a processor 84 (which may represent one or more processors), such as an application-specific processor. The controller 82 may also include a memory device 86 for storing instructions executable by the processor 84 to perform methods and control actions described herein relating to the platform 30. The processor 84 may include one or more processing devices, and the memory device 86 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by the processor 84 or by any general purpose or special purpose computer or other machine with a processor.

In the embodiment depicted in FIG. 3, the ride system 10 includes two vehicle detection systems 80 disposed adjacent to opposing lengths 83 of the platform 30. Specifically, the vehicle detection system 80 may be disposed across or coupled to the first, second, third, and fourth portions 40, 42, 46, 48 of the attraction loops 14 and the auxiliary loop 16. Indeed, in the current embodiment, the vehicle detection systems 80 may be physically separate from the platform 30, and the platform 30 may move relative to the vehicle detection systems 80 as the platform 30 transitions between the primary position 39 and the secondary position 45. However, in other embodiments, the vehicle detection systems 80 may be coupled to the platform 30 via an extension (e.g., support, rod, etc.) coupling components (e.g., sensors) of the vehicle detection system 80 to the platform 30.

In some embodiments, there may be more than two vehicle detection systems 80. For example, in some embodiments, there may be eight vehicle detection systems 80. Specifically, in embodiments where the vehicle detection systems 80 are coupled to the platform 30 as described above, there may be a vehicle detection system 80 coupled to the opposite lengths 83 of the platform and on opposite sides of each of the first track segment 32, the second track segment 34, the third track segment 36, and the fourth track segment 38. In embodiments where the vehicle detection systems 80 are separate from the platform 30 and the platform 30 moves relative to the vehicle detection systems 80, each vehicle detection system 80 may be disposed generally adjacent and parallel to the opposing lengths 83 of the platform and on both sides of each of the first portion 40, the second portion 42, the third portion 46, and the fourth portion 48 of the attraction loops 14 and the auxiliary loop 16.

Each vehicle detection system 80 may detect ride vehicles 12 entering and/or exiting the platform 30. To this end, each vehicle detection system 80 may include a sensor emitter 88 and a sensor receiver 90. In one implementation, the sensor emitter 88 may emit a beam (e.g., laser or a light amplification by stimulated emission of radiation) that may be received by the sensor receiver 90. If a ride vehicle 12 passes between the sensor emitter 88 and sensor receiver 90, the ride vehicle 12 may break the beam such that the sensor receiver 90 at least momentarily does not receive (e.g., sense) the beam emitting from the sensor emitter 88. If the sensor receiver 90 does not receive the beam at least momentarily, the vehicle detection system 80 may send a signal to the controller 82 indicating that one of the ride vehicles 12 has crossed the corresponding vehicle detection system 80, and more specifically, has crossed the path of the beam from the sensor emitter 88 to the sensor receiver 90 of the corresponding vehicle detection system 80. In some embodiments, the vehicle detection system 80 may also send a time signal to the controller indicating the length of time that the sensor receiver 90 does not receive the beam. The controller 82 may utilize the time signal to determine a speed of the ride vehicle 12 as it passed through the path of the beam.

The controller 82 may also receive information from the platform detection system 81. As seen in FIG. 3, the platform detection system 81 may be disposed on an edge of the length of travel of the platform 30 as the platform 30 travels between the primary position 39 and the secondary position 45. For example, the platform detection system 81 may include a first platform sensor 92 that may detect when the platform 30 is nearing or at the primary position 39. Similarly, the platform detection system 81 may also include a second platform sensor 94 that may detect when the platform 30 is nearing or at the secondary position 45. The first and second platform sensors 92, 94 may be proximity sensors including but not limited to capacitive sensors, capacitive displacement sensors, Doppler Effect sensors, eddy-current sensors, inductive sensors, magnetic sensors, optical sensors, radar sensors, sonar sensors, ultrasonic sensors, Hall Effect sensors, or any combination thereof. In some embodiments, the first and second platform sensors 92, 94, may be physical switches that the platform 30 may actuate (e.g., switch, trigger, etc.) through physical contact. In some embodiments, the first and second platform sensors 92, 94 may physically prevent the platform 30 from moving beyond primary and secondary positions 39, 45, respectively. For example, in some embodiments, the first and second platform sensors 92, 94 may include a physical stop or bumper to stop motion of the platform 30. Regardless, the first and second platform sensors 92, 94 may be located such that the first platform sensor 92 may sense, or be actuated, when the platform 30 is in the primary position 39 and the second platform sensor 94 may sense, or be actuated, when the platform 30 is in the secondary position 45. When the platform detection system 81 detects the presence of the platform 30 (e.g., in either the primary or secondary positions 39, 45) the platform detection system 81 may send a position signal to the controller 82 indicative of the location of the platform 30.

As discussed in further detail below with respect to FIGS. 4 and 5, the platform 30 may be at least partially powered by one or more motors to translate between the primary and secondary positions 39, 45 and to rotate the turntable 64. Additionally, or in the alternative, the platform 30 may include translational holds 96 and rotational holds 98 that operators may utilize to at least partially power (e.g., motivate) the platform 30 to travel between the primary and secondary positions 39, 45 and to rotate the turntable 64. The holds 96, 98 may be any suitable structure or object to which the operator may couple a tool (e.g., rod, hook, etc.). In some embodiments, the holds 96, 98 may be small rigid loops, such as eyelets, extending above the platform 30. Operators may translate the platform 30 between the primary and secondary positions 39, 45 by coupling to the translational holds 96 with a tool and pulling and/or pushing the platform 30 between the primary and secondary positions 39, 45. Similarly, the operator may rotate the platform 30 by coupling to the rotational holds 98 with a tool and pulling and/or pushing the turntable 64 in a substantially tangential direction relative to the center of the turntable 64.

Figure 4:
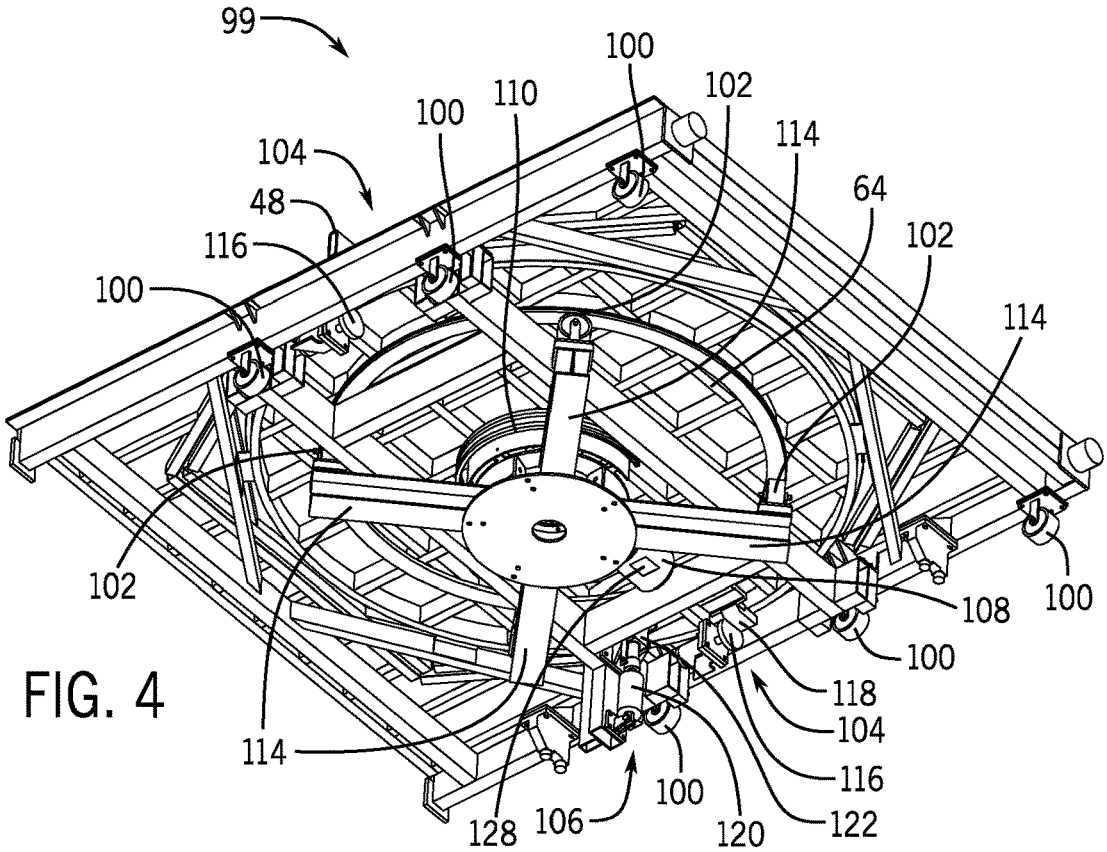
FIG. 4 is a bottom perspective view of an embodiment of a portion of the platform of FIG. 1, in accordance with present techniques.
Figure 5:
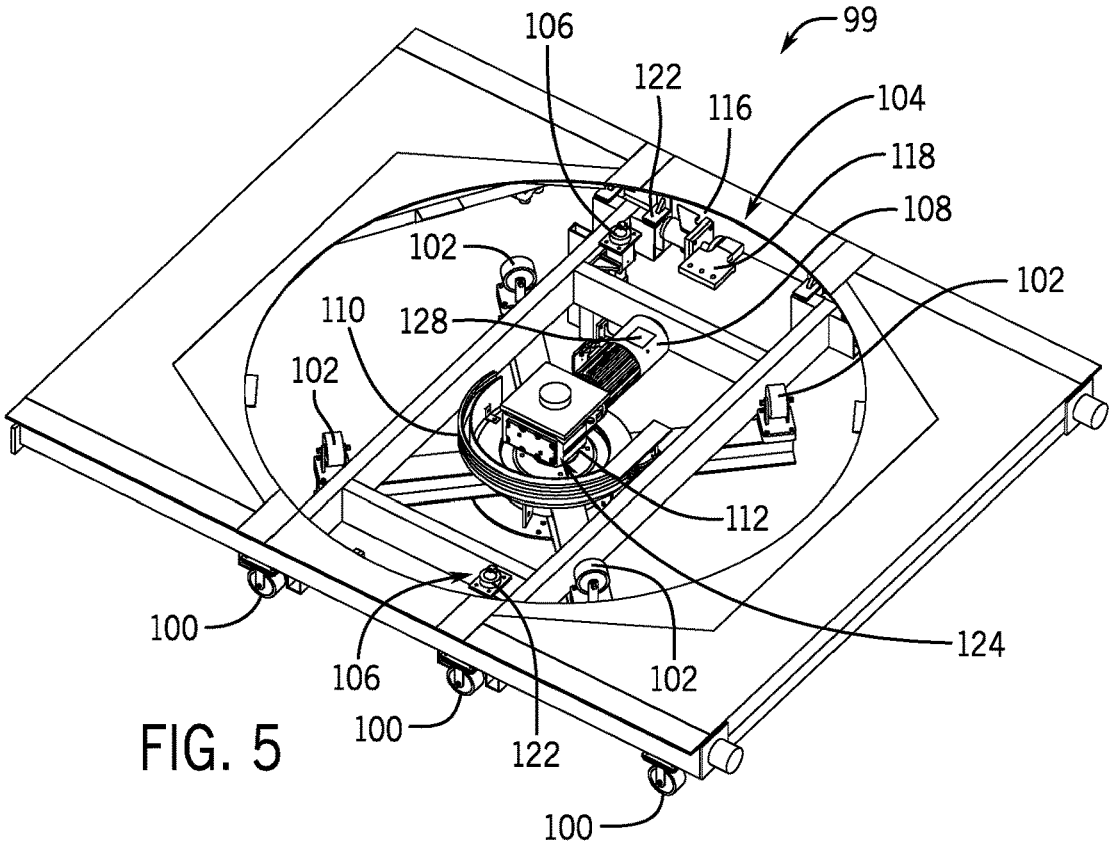
FIG. 5 is a top perspective view of an embodiment of a portion of the platform of FIG. 1, in accordance with present techniques.

FIGS. 4 and 5 are perspective views of a turntable portion 99 of the platform 30 which includes the turntable 64. Specifically, FIG. 4 depicts an underside view of the turntable portion 99 of the platform 30 while FIG. 5 depicts a topside view of the turntable portion 99 with the turntable 64 omitted in the interest of better illustrating certain features of the platform 30. Overall, the turntable portion 99 of the platform 30 may include several features to enable the functionality of the platform 30 as described herein. For example, the turntable portion 99 may include two or more translational casters 100 (e.g., wheels), two or more rotational casters 102 (e.g., wheels), a damping assembly 104, one or more locking pin assemblies 106, a motor 108, a busbar 110, a gearbox 112, or any combination thereof. It should be noted that a similar but essentially opposite arrangement is used in embodiments with the ride vehicles 12 that may hand down from overhead tracks 23.

The translational casters 100 may be coupled to the platform 30 and move along the floor of the ride system 10 when the platform 30 translates between the primary and secondary positions 39, 45. In certain embodiments, the translational casters 100 may move along a stationary platform raised above the floor of the ride system 10. Specifically, the translational casters 100 may support at least a portion of the weight of the platform 30 and balance the platform 30 while the platform 30 moves along the platform track 44 (FIG. 3). In some embodiments, the platform 30 may include any suitable number of translational casters 100. The rotational casters 102 may specifically be coupled to the turntable portion 99 of the platform 30, but unlike the translational casters 100, the rotational casters 102 may interface with an underside of the turntable 64. For example, at least a portion of the weight of the turntable 64 and/or the ride vehicle 12 may be supported by the rotational casters 102. In this manner, when the turntable 64 rotates (e.g., to rotate the ride vehicle 12), the rotational casters 102 may roll along the underside of the turntable 64. Indeed, the rotational casters 102 may be oriented such that the rotational casters 102 roll along the underside of the turntable 64 in a tangential direction relative to the center of the turntable 64. In some embodiments the rotational casters 102 may be coupled to arms 114 (e.g., rigid beams) extending outwardly from the turntable portion 99 below the center of the turntable 64.

The turntable portion 99 may also include a damping assembly 104. In some embodiments, the damping assembly 104 may include one or more dampers 116 and a bumper 118. The position of the dampers 116 may determine the amount of rotation permitted by the turntable 64. In the current embodiment, the platform 30 includes two dampers 116 disposed at opposite ends of the turntable portion 99 and the bumper 118 is coupled to an underside of the turntable 64. In this manner, the turntable 64 is limited to rotate between 180 degrees. For example, at zero degrees of rotation, the bumper 118 may be contacting one of the dampers 116. The turntable 64 may then rotate 180 degrees before the bumper 118 contacts the other damper 116, thereby preventing further rotation of the turntable 64. The dampers 116 and the bumper 118 may be made from a variety of durable materials including rubbers, plastics, and/or metals. In some embodiments, the dampers 116 may be positioned such that the turntable 64 is permitted to rotate more or less than 180 degrees.

The locking pin assemblies 106 may work with the damping assembly 104 to aid in determining an end rotational position of the turntable 64. For example, when the bumper 118 is contacting one of the dampers 116, one or more locking pin assemblies 106 may engage, thereby preventing the turntable 64 from rotating out of a desired position. In the current embodiment, the locking pin assembly 106 includes a locking pin 120 and two locking pin receptacles 122. The locking pin 120 may be coupled to the turntable portion 99 of the platform 30, and the locking pin receptacles 122 may be coupled to the turntable 64 at opposite ends of the turntable 64 (e.g., 180 degrees apart relative to the center of the turntable 64). In this manner, when the turntable 64 is in a first position (e.g., zero degrees), one of the locking pin receptacles 122 may be positioned above the locking pin 120. To prevent rotation out of the first position, the locking pin 120 may be actuated (e.g., hydraulically actuated) to extend into the locking pin receptacle 122, thereby locking the turntable in the first position. Indeed, for the turntable 64 to rotate out of the first position, the locking pin 120 may first be withdrawn from the locking pin receptacle 122. The turntable 64 may then rotate (e.g., rotate 180 degrees) to a second position such that a different locking pin receptacle 122 is positioned over the locking pin 120. Once again, to prevent the turntable 64 from then rotating out of the second position, the locking pin 120 may be actuated to extend into the locking pin receptacle 122. In some embodiments, the locking pin receptacles 122 may be located to lock the turntable 64 in positions located more or less than 180 degrees apart.

Also as mentioned above, the turntable portion 99 of the platform 30 may include the motor 108, the gearbox 112, and the busbar 110. The motor 108 may supply rotational power to the gearbox 112. The gearbox 112 may then convert the rotational power supplied from the motor 108 to a suitable rotational speed which is supplied to the turntable 64 through a connection 124. The connection 124 may be a splined connection configured to be received by the turntable 64. In this manner, the rotational power from the motor 108 may be supplied to the turntable 64 to rotate the turntable 64. In some embodiments, the motor 108 also supplies power to translate the platform 30 between the primary and secondary positions 39, 45. In other embodiments, the platform 30 may include a second motor 123 (FIG. 3) that is dedicated to translating the platform 30 between the primary and secondary positions 39, 45. In such embodiments, the second motor 123 may be mounted to a floor of the ride system 10 and the platform 30 may move relative to the second motor 123. Further, in some embodiments, the busbar 110 may receive power from a power source (e.g., a generator, electrical power grid, etc.) in order to supply the power to the motor 108. In some embodiments, the motor 108 may receive power directly from the power source (e.g., through a wire). In some embodiments, the busbar 110 may be communicatively coupled to the controller 82 and communicate various parameters (e.g., position) of the platform 30 to the controller 82. In some embodiments, the platform 30 may include one or more rotational sensors 128 (e.g., encoders, magnetic sensors, Hall-effect sensors, etc.) which may measure a degree of rotation of the turntable 64. Particularly, in some embodiments, the motor 108 may include the rotational sensor 128. Overall, the one or more rotational sensors 128 may measure an amount of rotation of the turntable 64 and send data indicative of the measured amount of rotation to the controller 82, which may then determine the amount of rotation of the turntable 64 based on the data.

Figure 6:
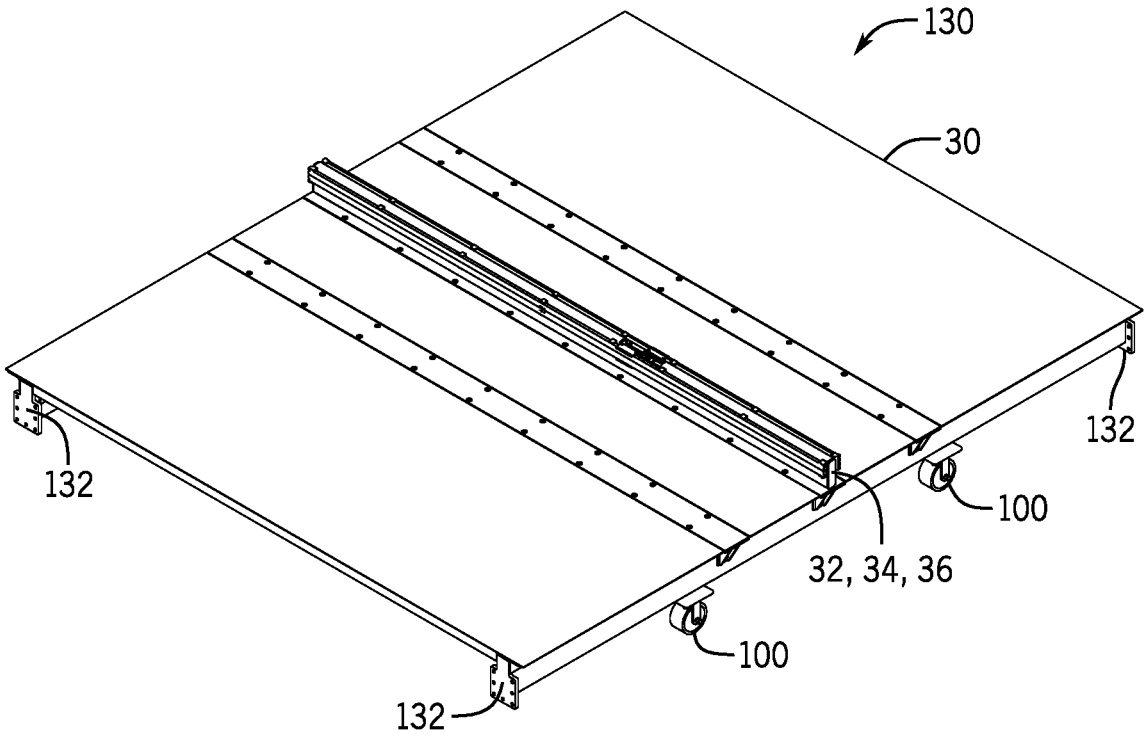
FIG. 6 is a top perspective view of an embodiment of a portion of the platform of FIG. 1, in accordance with present techniques.

FIG. 6 is a perspective view of a non-rotational portion 130 of the platform 30 that may include the first, second, or third track segments 32, 34, 36. Similar to the turntable portion 99, the non-rotational portion 130 may include translational casters 100 (e.g., wheels) that may support the weight of the non-rotational portion 130 and any ride vehicle 12 that may be disposed on the non-rotational portion 130. The translational casters 100 may also help to balance the platform 30 as it translates between the primary and secondary positions 39, 45. Furthermore, the turntable and non-rotational portions 99, 130 of the platform 30 may be coupled to each other by connector plates 132. For example, the connector plates 132 of a portion (e.g., turntable and/or non-rotational portions 99, 130) of the platform 30 may be coupled to the connector plates 132 of an adjacent portion of the platform 30. In some embodiments, connector plates 132 of adjacent portions of the platform 30 may be bolted to each other. In this manner, the connector plates 132 may easily be decoupled for various reasons (e.g., maintenance). However, additionally, or in the alternative, the connector plates 132 of adjacent portions of the platform 30 may be welded to each other.

Figure 7:
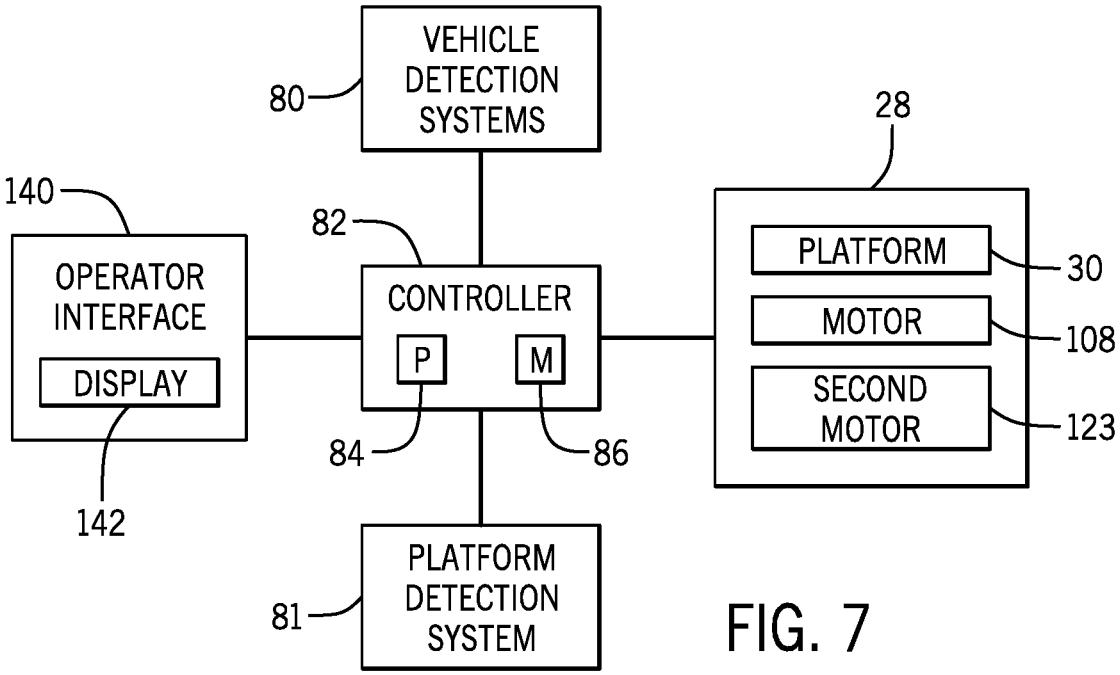
FIG. 7 is a block diagram of the ride system of FIG. 1, in accordance with present techniques.

FIG. 7 is a block diagram of the ride system 10. As seen in FIG. 7, the controller 82 is communicatively coupled to the platform 30, the vehicle detection systems 80, and the platform detection systems 81. Indeed, in some embodiments, the controller 82, the platform 30, the vehicle detection systems 80, and the platform detection systems 81 may communicate through a wireless network (e.g., wireless local area networks [WLAN], wireless wide area networks [WWAN], near field communication [NFC]) and/or through a wired network (e.g., local area networks [LAN], wide area networks [WAN]).

As discussed above, the controller 82 may receive various signals from the vehicle detection systems 80 and/or the platform detection system 81 related to positions of the ride vehicles 12 and the platform 30. Also as discussed above, the controller 82 may process and analyze these signals to determine the positions of the ride vehicles 12 and the platform 30. In some embodiments, the controller 82 may communicate the positions of the ride vehicles 12 and the platform 30 to an operator via an operator interface 140, which may include a display 142. In some embodiments, an operator may send one or more signals to the controller 82 via the operator interface 140 to operate the platform 30 as discussed herein, for example, to translate and/or or rotate portions of the platform 30.

For example, in one embodiment, the controller 82 may receive a signal, or data, that one or more ride vehicles 12 approaching the track switch assembly 28 are scheduled for maintenance or have an error or other maintenance flag associated with the vehicles 12. As the ride vehicle or ride vehicles 12 approach the track switch assembly 28, the ride vehicles 12 receive a brake signal to slow down to be moved into position on the track switch assembly 28. If the platform 30 is not in position to receive the ride vehicles 12, the track switch assembly 28 also receives a signal to move the turntable 64 to the appropriate track 23 of the attraction loops 14. Based on signals that the ride vehicles 12 are in position (e.g., from the vehicle detection system 80), the track switch assembly 28 is activated to move the platform 30 and the turntable 64 to move the ride vehicles 12 onto the auxiliary loop 16. In another example, when the ride is in operation and the ride vehicles 12 traversing the attraction loops 14 have no maintenance signal, the platform 30 is in a position such that its track segments close or complete the attraction loops 14 and permit ride vehicles 12 that do not require maintenance to cross over the platform 30 while the platform 30 is stationary.

While only certain features of the invention have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a dual-track loop comprising a first track loop and a second track loop;

a single-track loop spaced apart from the dual-track loop;

a cross-track extending between the dual-track loop and the single-track loop;

a platform disposed on the cross-track, the platform configured to translate between a position aligned with the first track loop and the second track loop of the dual-track loop and a position aligned with a first portion and a second portion of the single-track loop; and a turntable coupled to the platform and configured to rotate a first ride vehicle positioned on the turntable and to change an orientation of the first ride vehicle relative to a second ride vehicle on a fixed portion of the platform.

2. The system of claim 1, wherein a first distance separating the first track loop and the second track loop adjacent the cross-track is approximately equal to a second distance separating the first portion and the second portion of the single-track loop adjacent the cross-track.

3. The system of claim 1, comprising a motor configured to rotate the first ride vehicle via the turntable.

4. The system of claim 1, wherein the platform is configured to receive the first ride vehicle from the first track loop and the second ride vehicle from the second track loop while the platform is in a primary position, and wherein the single-track loop is configured to receive the first ride vehicle and the second ride vehicle from the platform while the platform is in a secondary position.

5. The system of claim 4, wherein the platform is configured to receive the first ride vehicle while the first ride vehicle is oriented in a first direction relative to the platform, wherein the single-track loop is configured to receive the first ride vehicle while the first ride vehicle is oriented in a second direction relative to the platform, and wherein the first direction is substantially opposite to the second direction.

6. The system of claim 4, wherein the platform comprises a first track segment, a second track segment, a third track segment, and a fourth track segment, and wherein the fourth track segment is coupled to the turntable of the platform.

7. The system of claim 6, wherein the third track segment is substantially collinear with the first track loop and the fourth track segment is substantially collinear with the second track loop while the platform is in the primary position.

8. The system of claim 6, wherein the first track segment is substantially collinear with the first track loop, the second track segment is substantially collinear with the second track loop, the third track segment is substantially collinear with the first portion of the single-track loop, and the fourth track segment is substantially collinear with the second portion of the single-track loop while the platform is in the secondary position.

9. The system of claim 1, comprising:

a vehicle detection system configured to detect a location of the first ride vehicle;

a platform detection system configured to detect a position of the platform; and a controller configured to coordinate operation of the platform based on data received from the vehicle detection system indicative of the location of the first ride vehicle and based on data received from the platform detection system indicative of the position of the platform.

10. A system, comprising:

a platform, wherein the platform comprises a stationary portion and a rotational portion;

a track segment, wherein the track segment is coupled to the rotational portion, and wherein the rotational portion is configured to rotate relative to the stationary portion to cause the track segment to rotate;

a first motor coupled to the rotational portion and configured to rotate the rotational portion;

a rail coupled to the platform such that the stationary portion and the rotational portion of the platform are configured to translate along the rail; and a second motor coupled to the platform and configured to translate the platform along the rail.

11. The system of claim 10, wherein the track segment is a first track segment and further comprising a second track segment, a third track segment, and a fourth track segment coupled to the stationary portion, and wherein rotation of the rotational portion causes the first track segment to change in orientation relative to the second track segment, the third track segment, and the fourth track segment.

12. The system of claim 10, comprising one or more vehicle detection systems configured to detect one or more ride vehicles entering and/or exiting the platform.

13. The system of claim 10, comprising a platform detection system configured to detect a location of the platform along the rail.

14. The system of claim 10, wherein the platform is configured to translate based on a signal from a controller that a vehicle positioned on the platform is scheduled for maintenance.

15. A method, comprising:

receiving on a first track segment of a platform a first ride vehicle from a first track, wherein the platform comprises a stationary portion and a rotational portion;

receiving on a second track segment of the platform a second ride vehicle from a second track;

translating the stationary portion and the rotational portion of the platform along a rail using a first motor to move the first ride vehicle away from the first track to align the first track segment with a first portion of a third track loop and to move the second ride vehicle away from the second track to align the second track segment with a second portion of the third track loop;

rotating a rotational portion of the platform using a second motor to rotate the second ride vehicle;

dispatching the first ride vehicle from the platform to the third track loop; and dispatching the second ride vehicle from the platform to the third track loop.

16. The method of claim 15, comprising:

determining, via a controller, a location of the platform.

17. The method of claim 15, comprising:

determining, via a controller, that the platform receives the first ride vehicle or the second ride vehicle based on a first signal from a vehicle detection sensor; and determining, via the controller, that the platform dispatches the first ride vehicle or the second ride vehicle based on a second signal from the vehicle detection sensor.

18. The method of claim 15, comprising:

translating the platform based on a maintenance signal associated with at least the first ride vehicle or the second ride vehicle.

19. The method of claim 15, wherein translating the platform and rotating the platform occur simultaneously.

* * * * *